United States Patent [19]

Landry et al.

[11] 4,123,102

[45] Oct. 31, 1978

[54] ADJUSTABLE RECLINING CHAIR HAVING THREE-POINT SUSPENSION, AND METHOD

[75] Inventors: Archie C. Landry, Canoga Park, Calif.; Alexander C. Daswick, 647 Orange Grove, South Pasadena, Calif. 91030

[73] Assignee: Alexander C. Daswick, South Pasadena, Calif.

[21] Appl. No.: 817,997

[22] Filed: Jul. 22, 1977

[51] Int. Cl.[2] ..... A47C 1/02; A47C 3/029

[52] U.S. Cl. ..... 297/270; 297/310; 297/325

[58] Field of Search ..... 297/310, 270, 325, 326, 297/329, 328, 272, 258, 377

[56] References Cited

U.S. PATENT DOCUMENTS

| | | | |
|---|---|---|---|
| 141,121 | 7/1873 | Collins | 297/328 X |
| 490,366 | 1/1893 | Seng | 297/310 X |
| 642,092 | 1/1900 | DeMoulin | 297/325 X |
| 912,354 | 2/1909 | Barnickle | 297/310 |
| 1,083,215 | 12/1913 | Lewis | 297/310 |
| 2,052,715 | 9/1936 | Kistemacher | 297/272 |
| 3,075,810 | 1/1963 | Kitsopoulos | 297/270 |
| 3,272,556 | 9/1966 | Rocker | 297/310 |
| 3,804,459 | 4/1974 | Nose | 297/258 |

FOREIGN PATENT DOCUMENTS

| | | | |
|---|---|---|---|
| 2,241,209 | 8/1973 | Fed. Rep. of Germany | 297/258 |
| 2,347,896 | 4/1974 | Fed. Rep. of Germany | 297/310 |

*Primary Examiner*—Francis K. Zugel

*Attorney, Agent, or Firm*—Gene W. Arant

[57] ABSTRACT

A rocker-type chair is used which is normally unbalanced in a rearwardly reclining direction. A rear support frame has its lower and rearward end in engagement with the floor while its upper and forward end is pivotally secured to the rearward side of the chair. The rear support frame is forcibly pivotally rotated relative to the chair in order to selectively vary the extent to which the chair reclines rearwardly.

As the pivoting action takes place, the main part of the chair turns upon its rocker-like members. The lower and rearward end of the rear support frame slides or rolls horizontally along the floor surface. The weight of the occupant of the chair is at all times divided between two forward support points which are provided by the rocker-like members, and a rear support point which is provided by the rear support frame.

9 Claims, 9 Drawing Figures

ADJUSTABLE RECLINING CHAIR HAVING THREE-POINT SUSPENSION, AND METHOD

PRIOR ART

The present invention provides an improvement over the invention disclosed in U.S. Pat. No. 3,999,799 issued Dec. 28, 1976 to Alexander C. Daswick and entitled "ADJUSTABLE RECLINING CHAIR, AND METHOD."

While the present invention is not closely related to the various inventions disclosed and claimed in our copending application Ser. No. 760,997 filed Jan. 21, 1977, it may nevertheless be desirable to incorporate one or more of the inventive features shown in our copending application in the type of adjustable reclining chair that is presently disclosed and claimed herein.

BACKGROUND OF THE INVENTION

The main object and purpose of the present invention is to provide an adjustable reclining chair which is more economical to manufacture than that disclosed in the referenced Daswick U.S. Pat. No. 3,999,799, and which may also be simpler and more reliable in its operation.

A further object of the invention is to provide an improved type of adjustable reclining chair, which also has at least a limited amount of rocking capability, regardless of its position of reclining adjustment.

SUMMARY OF THE INVENTION

According to the present invention a complete chair assembly includes a chair that is equipped with a pair of rocker-like members, but which is deliberately unbalanced in the rearward direction. That is, the chair by itself would tend to recline rearwardly through a considerable angle. The complete chair assembly also includes a rear support frame or leg which is inclined at an angle, with its rearward and lower end engaging the floor while its upper and forward end is pivotally attached to the rearward side of the chair. A manually operated drive means is also provided for forcibly pivotally rotating the rear support frame relative to the chair, in order to selectively adjust the reclining position of the chair.

The invention also provides a method for achieving an adjustable reclining chair action, by selecting a chair of the rocker type that is unbalanced in the rearward direction, pivotally attaching a rear support frame to the rear side of the chair, and then forcibly rotating the rear support frame relative to the chair in order to adjust the angle of recline.

According to the invention the pair of rocker-like members which support the chair move in a rocking action upon the floor surface, while the lower and rearward end of the rear support frame moves horizontally along the lower surface. The floor-engaging end of the rear support frame or leg may slide along the floor surface, or it may be equipped with a ball or other type of roller for rolling along the floor surface.

It is greatly preferred to include resilient means in the rear support frame so that, at any selected angle of recline of the chair, it is also possible for the occupant of the chair to rock back and forth by short distances without changing the angular adjustment of the rear support frame.

According to an alternate form of the invention the rear support frame is provided with two laterally separated feet, each of which is resiliently supported by spring means from the support frame, so that the rear support frame effectively provides the mechanical equivalent of a single support point for the chair. Although there are in fact four support points for the entire chair assembly, the mechanical action is effectively the same as for three support points.

DRAWING SUMMARY

PREFERRED EMBODIMENT

(FIGS. 1–6)

Figure 1:
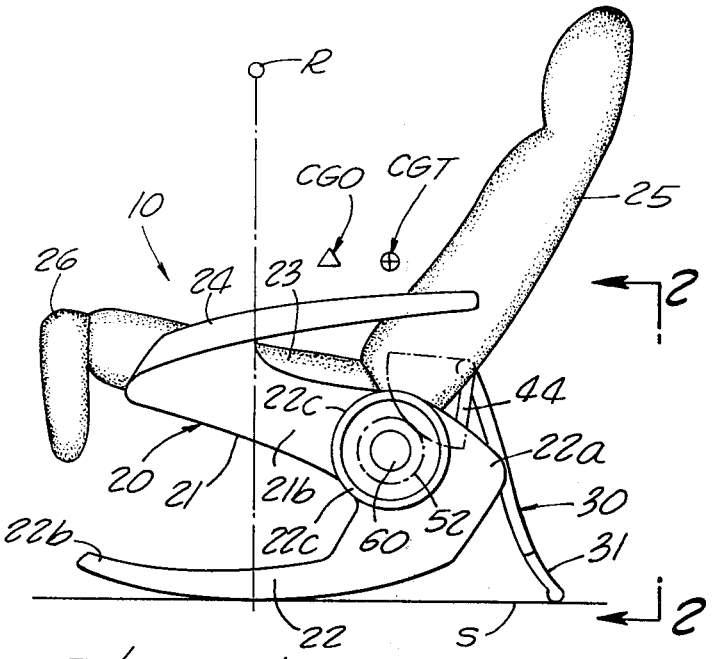
FIG. 1 is a side elevation view of a chair assembly in accordance with the invention.

Reference is now made to FIGS. 1 through 6, inclusive, of the drawings illustrating the presently preferred embodiment of the invention.

A chair assembly 10 includes, in general, a chair 20 which is in part supported by a rear support frame 30, the support frame being secured to the chair by pivotal support means 40. Chair 20 is not of conventional construction, but is believed to be unique both in its construction and its method of operation.

Specifically, the chair 20 includes a chair frame 21 having a seat support **21*a* and side pieces 21*b* which together receive and support a seatrest 23. A pair of side arms 24 are preferably formed integral with the chair frame 21. Also included as a part of chair 20 are a pair of semi-rockers 22**.

The upper and rearward end **22*a* of the semi-rockers is securely attached to the rearward end of chair frame 21 so as to move in unison with the seatrest 23. More specifically, it is in fact preferred to construct the semi-rockers 22 integral with the chair frame 21**.

The following explanation will aid in understanding the structure and function of the semi-rockers 22. If the semi-rockers were made of full length, so as to approximately conform to a pair of standard rockers, they would then be about twice too long for the length of the seatrest 23. In other words, the semi-rockers 22 have approximately the same configuration as the rearward half of a pair of standard rockers, except that their length is approximately equal to that of the seatrest.

Figure 6:
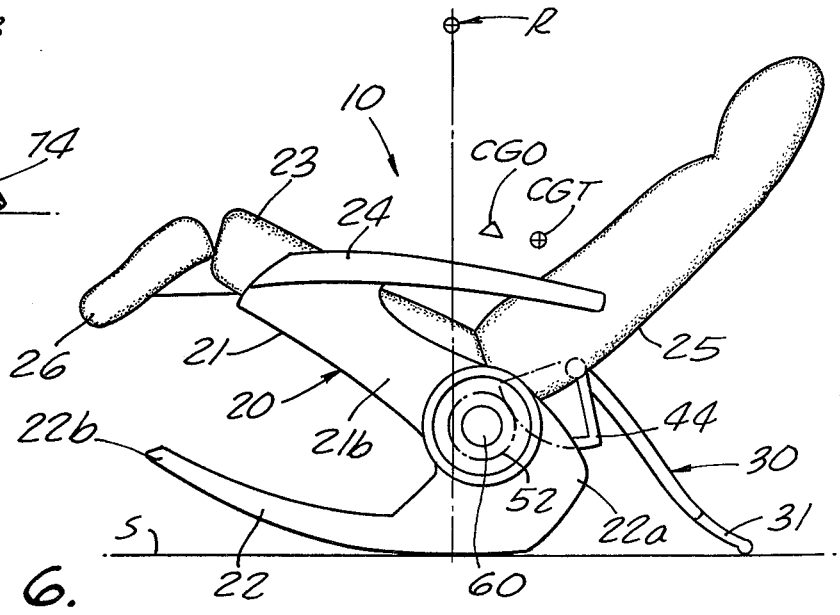
FIG. 6 is a view like FIG. 1, but showing the chair in a much more rearwardly inclined position.

As a result of this unique construction of the chair 20, if the seatrest 23 were to be positioned approximately horizontally, a supporting floor surface S will then be engaged by the semi-rockers 22 at their forward ends **22*b*, but not at their mid point or at their rearward end. At the same time, the curvature of the semi-rockers 22 and the angle of inclination of seatrest 23 relative to the semi-rockers are such that, when the semi-rockers engage the floor surface S at approximately the mid point of their length, as shown in FIG. 1, the seatrest 23 then inclines rearwardly at an angle in the order of 15°. As shown in FIG. 6, if the semi-rockers engage the floor surface near their rearward ends, the seatrest 23** is then inclined rearwardly at an angle of the order of 45°.

Also included in the chair 20 is a backrest 25 which is preferably supported in a fixed position relative to the chair frame 21. In the illustrated embodiment a backrest supporting frame 25*a* is securely fastened to, or even formed integral with, the chair frame 21. A recessed portion 25*b* of the backrest frame 25*a* is specially designed for providing the pivotal support of the rear support frame 30.

Chair 20 also includes a footrest 26, which is preferably pivotally adjustable between different positions, as shown in FIGS. 1 and 6. However, the pivotal support for the footrest forms no part of the present invention, and is therefore not illustrated in the present drawings.

Figure 2:
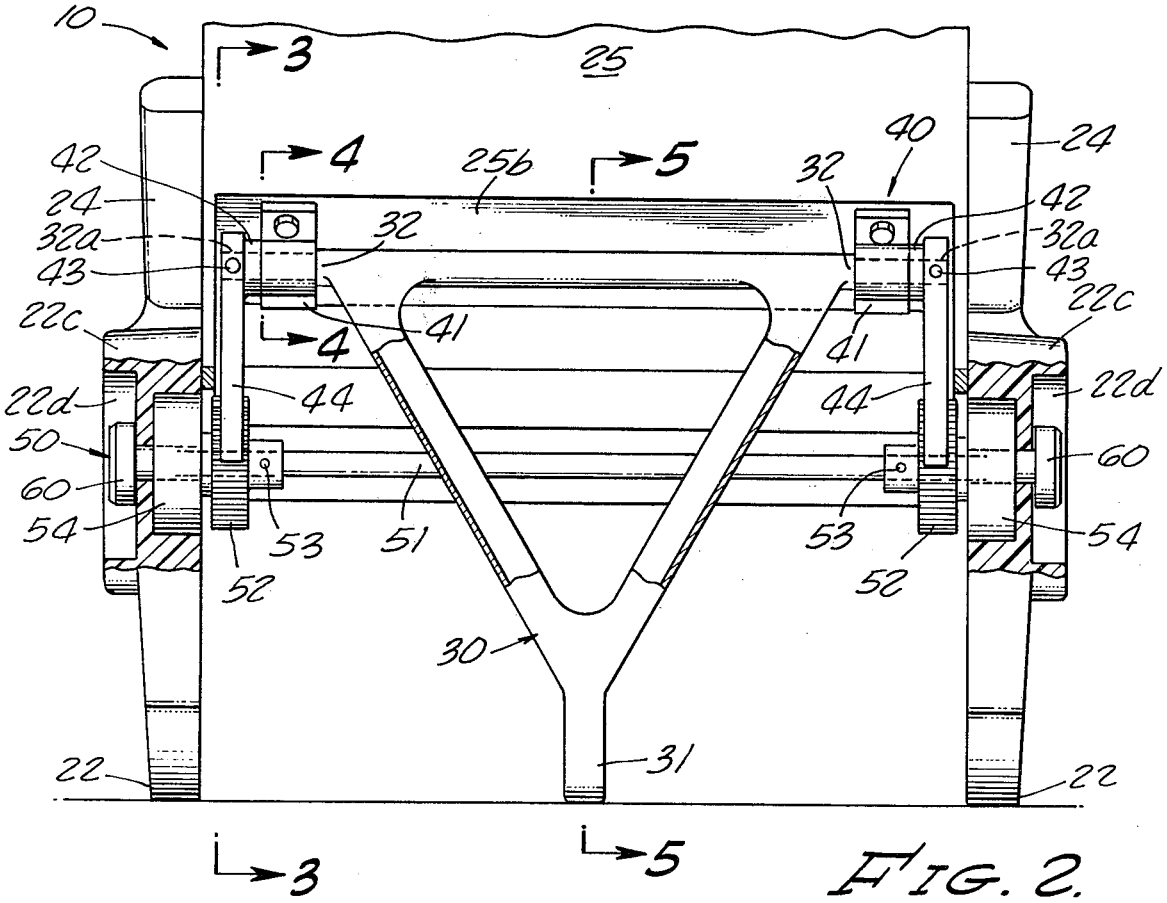
FIG. 2 is a rear elevation view, on an enlarged scale, taken on line 2—2 of FIG. 1.
Figure 3:
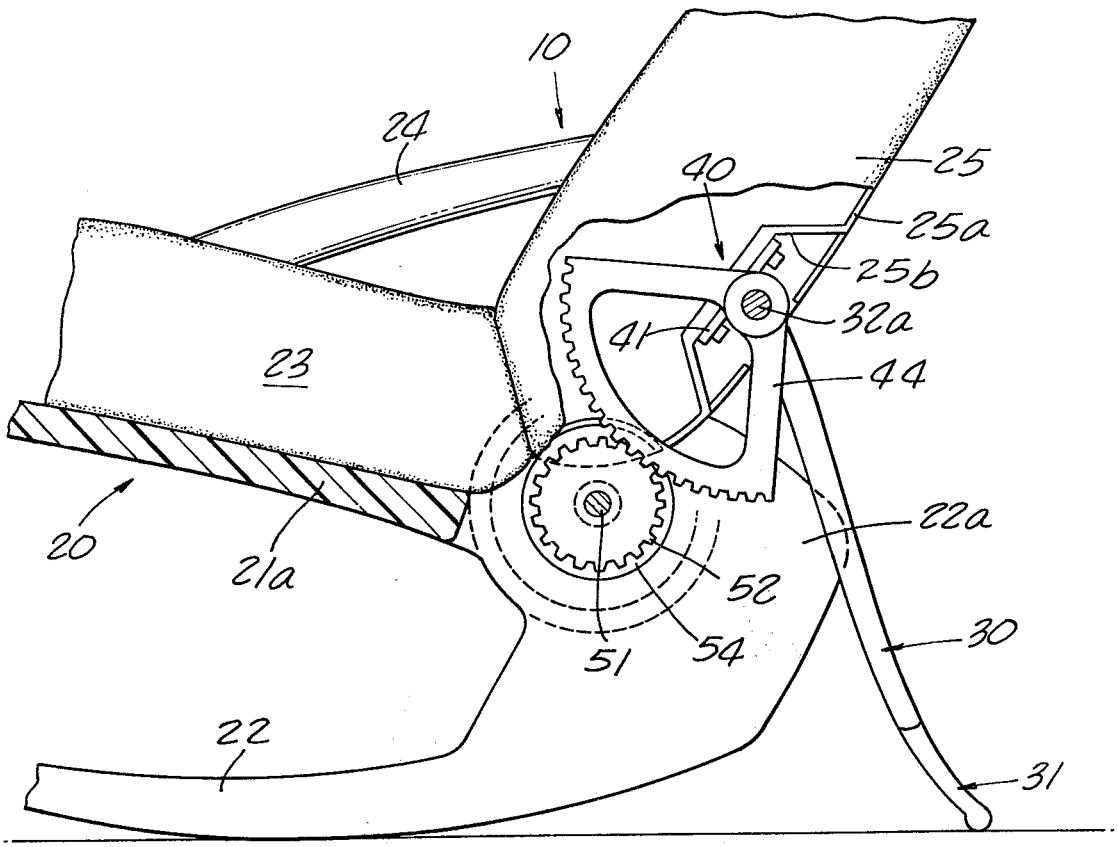
FIG. 3 is a fragmentary side elevation view, partially in cross-section, taken on line 3—3 of FIG. 2.
Figure 4:
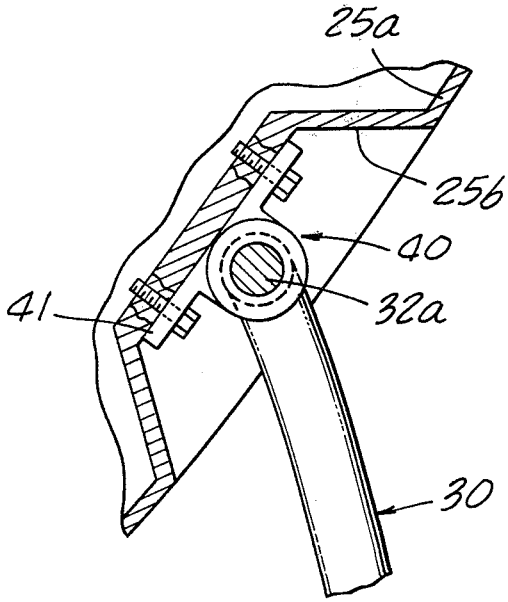
FIG. 4 is a fragmentary side elevation view, partially in cross-section, taken on line 4—4 of FIG. 2.
Figure 5:
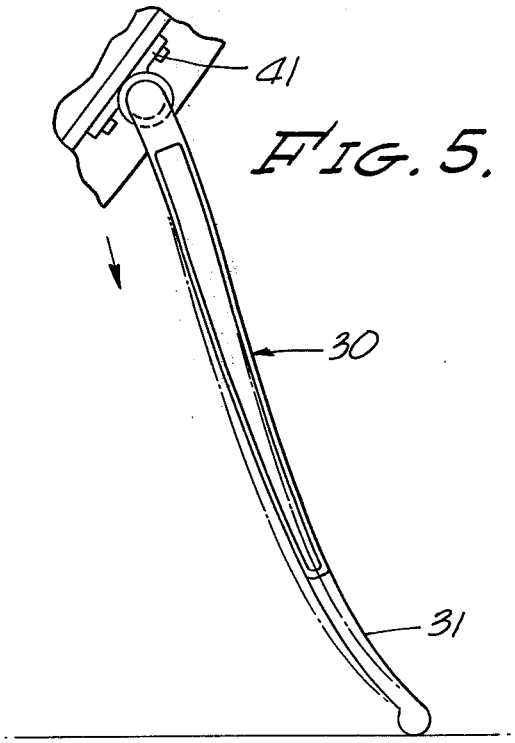
FIG. 5 is an elevational view of the rear support frame or leg taken on the line 5—5 of FIG. 2.

As best seen in FIG. 2, the rear support frame 30 is of generally delta-shaped configuration. A leg 31 depends downwardly from its lowermost corner. Trunnioned ends 32 extend horizontally outwardly from its upper corners. The outer portion of each trunnioned end 32 has a reduced diameter as shown at 32*a* in FIG. 3.

A pair of journals 41 (FIGS. 2 and 4) are supported from opposite sides of the recessed portion 25*b* of the backrest frame 25*a*. A pair of cylinders 42 are carried on the end portions 32*a* of the support frame 30, and are pinned in place by respective pins 43. A gear segment 44 is formed integral with each of the cylinders 42, the plane of the gear segment being aligned perpendicular to the axis of the cylinder. Thus, the gear segments 44 pivot with the rear support frame 30, or more correctly, when pivotal movement is imparted to the gear segments 44, they produce a corresponding pivotal movement of the rear support frame.

It will therefore be apparent that the rear support frame 30 provides its own pivot shaft 32*a* — 32*a* and that the axis of this shaft is horizontal and extends transverse to the chair frame 21.

Drive means generally identified as 50 are also provided for forcibly rotatably driving the rear support frame 30 relative to the chair 20. Specifically, openings formed in the chair frame 21 near the juncture of the semi-rockers with the frame side pieces 21*b* receive a horizontally disposed drive shaft 51. Gear wheels 52 are carried on respective ends of the shaft 51, being pinned thereto by means of pins 53, and engage respective ones of the gear segments 44. Outside the gear wheels 52 a pair of weight wheels 54 are carried on the shaft 51. Each weight wheel is contained within a corresponding cylindrical recess in the enlarged portion 22*c* of the frame structure through which the drive shaft 51 passes. The weight wheels also tend to serve as brakes to limit the undesired rotation of the drive shaft 51.

A pair of manual control knobs 60 are secured to the outer ends of the drive shaft 51. Each control knob is housed within a recess 22*d* in the chair frame structure that is provided for that purpose.

OPERATION

For simplicity in the present illustration the curved floor-engaging surfaces of the semi-rockers 22 are shown as being formed as the arc of a circle, about a radius center R. The approximate center of gravity of the occupant of the chair is designated by means of a triangle in FIGS. 1 and 6, and labeled CGO. The approximate combined center of gravity of the occupant plus the chair 20 is identified by means of a cross inside a circle, and is labeled in both FIG. 1 and FIG. 6 as CGT. The points R, CGO and CGT are helpful in explaining the operation of the chair assembly 10.

More specifically, the composite center of gravity CGT is at all times rearwardly of the point where the semi-rockers 22 engage floor surface S. See FIG. 6. The weight load of the chair and its occupant, therefore, is divided between the two semi-rockers which provide two forward support points, and the rear support frame 30 which provides a single point of rear support.

When it is desired to change the angle of recline, the occupant of the chair simply grasps one or both of the manual control knobs 60. The drive shaft 51 is then rotated in the proper direction so as to either raise the chair, or lower it to a more reclining position.

Figure 7:
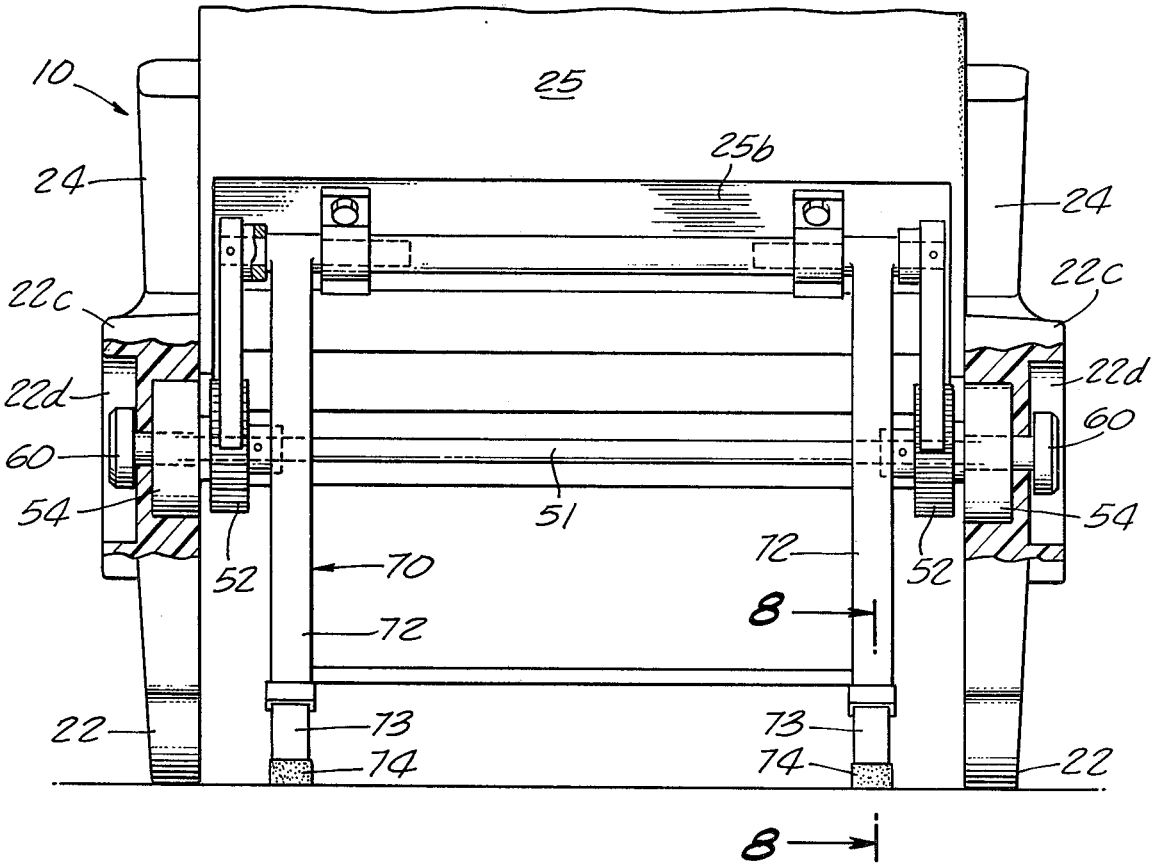
FIG. 7 is a rear elevation view like FIG. 2, but showing an alternate form of the rear support frame.
Figure 8:
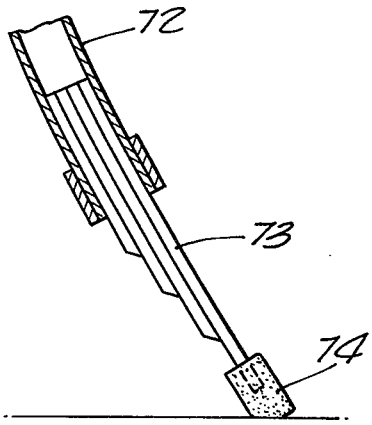
FIG. 8 is a detail cross-sectional view of one foot of the rear support frame, taken on the line 8—8 of FIG. 7.

Some limited rocking action of the chair can occur in any reclining position. This is made possible by the resilient construction of the rear support frame 30, and particularly by the incorporation of spring means as shown in FIGS. 7–8.

ALTERNATE FORMS

Although the semi-rockers 22 are presently illustrated as having surfaces curved according to the arc of a circle, it is in fact preferred to curve the surfaces somewhat differently. The semi-rockers 22 should be considered as pseudo-rockers, or more correctly as being cams. The design of the cam surfaces may be varied as desired, in conjunction with the location of pivot axis 32*a* and the design of the rear support frame 30.

While in the present illustration the pivot axis 32*a* is elevated some distance above the chair frame 21, it will in general be secured at or near the rearward end of the seatrest. The location of the pivot axis may be considerably lower than presently illustrated, and rather than being fastened to the backrest frame it may if desired be secured directly to the upper and rearward ends of the semi-rockers 22.

FIGS. 7 and 8 illustrate a modified form of rear support frame 70, having a pair of laterally separated legs 72. Each leg is equipped with a leaf spring 73 carrying a foot piece 74 on its lower extremity. Even though there are two separate rear support points in fact, the resilience of the leaf springs 73 causes the rear support frame 70 to effectively provide a single support point.

Figure 9:
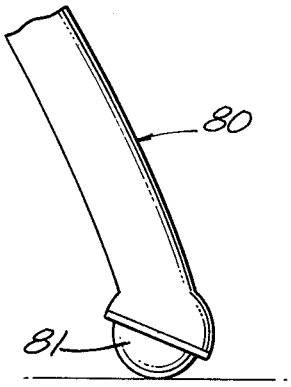
FIG. 9 is a fragmentary view of another alternate form of the rear support frame showing a ball roller on its floor-engaging end.

FIG. 9 illustrates a modified rear support leg 80 which carries a ballbearing 81. The ballbearing 81 permits the lower extremity of the support leg 80 to move along the floor surface S by means of a rolling support, rather than relying upon sliding friction.

While in the present drawings the rear support frame is illustrated as being pivotally secured to the chair, other methods of adjusting the floor-engaging end of the rear support may be utilized within the scope of the present invention.

Depending upon specific design values that are selected, and the angle of recline of the chair, the semi-rockers 22 will normally engage the floor surface within the range of about 3 to 15 inches forwardly of the composite center of gravity of the chair and its occupant. The rear support frame will normally engage the floor surface about 6 to 24 inches rearwardly of the composite center of gravity.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. An adjustable reclining chair with three-point suspension, comprising:

a chair frame having a seatrest, side arms, and a backrest;

a pair of semi-rocker-like members secured beneath said frame and normally engaging a floor surface to provide two front points of support;

a rear support frame angled downwardly and having its forward and upward end pivotally attached to said chair frame along a horizontal axis near the rearward end of said seatrest, the rearward and downward end thereof normally engaging the floor surface to effectively provide a single rear support point;

manually operable drive means, operable by the occupant while occupying the chair, for adjustably rotating said rear support frame relative to said chair frame to thereby adjust the angle of recline of said chair frame;

the chair being so constructed that in every position of said rear support frame both the center of gravity of the chair, and the composite center of gravity including the occupant when the chair is occupied, are at least about 3 inches rearwardly of said two front support points; and said rear support frame being resiliently constructed to permit limited rocking of the chair and its occupant, said drive means including a drive shaft disposed to the rear of said seat rest, said chair frame also having side frame portions in which the respective ends of said drive shaft are journaled; the ends of said drive shaft extending through said side frame portions and having knobs attached thereto so that the chair occupant may operate said drive shaft with either hand; and further including drive gear means coupling said drive shaft to the upper and forward end of said rear support frame.

2. An adjustable reclining chair as claimed in claim 1 wherein said rear support frame is of generally delta-shaped configuration having one corner which is lowermost, a leg which depends downwardly from said lowermost corner for engaging the floor surface, and also having trunnioned ends which extend horizontally outwardly from its upper corners for pivotally supporting same from said chair frame.

3. An adjustable reclining chair as in claim 1 wherein said rear support frame is of generally rectangular configuration having a pivot shaft with trunnioned ends attached to its upper and forward end for pivotally supporting same from said chair frame, the lower end of said frame being slightly curved in a rearwardly direction and also equipped with a pair of leaf springs extending downwardly from respective lower corners thereof, each leaf spring having a foot piece on its lower extremity.

4. An adjustable reclining chair as claimed in claim 1 wherein said semi-rocker-like members are spaced away from said chair frame at the forward end thereof and are attached to said chair frame only rearwardly of said seatrest.

5. An adjustable reclining chair as claimed in claim 4 wherein, at the longitudinal center of said semi-rocker-like members, said seatrest is tilted rearwrdly in the order of 15° relative to the floor-engaging surfaces of said member, and at the rearward end thereof, said seatrest is tilted in the order of 45°.

6. An adjustable reclining chair with three-point suspension, comprising:

a chair frame having a seatrest, frame side pieces on respective sides of said seatrest, side arms above said side pieces, and a backrest extending upwardly from the rearward end of said seatrest;

a pair of semi-rocker-like members disposed beneath respective ones of said frame side pieces, the rearward ends of said members being secured to and formed integral with respective ones of said frame side pieces, the angular relationship between said seatrest and said semi-rocker-like members being such that when said members engage the floor surface at their longitudinal centers, said seatrest is tilted rearwardly in the order of 15°;

a horizontally disposed drive shaft located rearwardly of said seatrest and underneath said backrest, said chair frame having openings at the juncture at each of said frame side pieces with the associated rocker-like member in which the ends of said drive shaft are journaled, the ends of said drive shaft protruding through said openings and having knobs thereon so that the chair occupant may rotate said drive shaft with either hand;

a rear support frame having its forward and upward end attached to a horizontal pivot shaft, said pivot shaft being pivotally supported from the rearward side of said backrest above said drive shaft;

a pair of gear wheels carried on respective ends of said drive shaft inside the respective frame side pieces; and a pair of gear segments carried on respective ends of said pivot shaft and engaging the corresponding ones of said gear wheels so that rotation of either of said hand knobs will drivingly rotate said rear support frame relative to said chair frame, thereby establishing the angle of rearward recline of said chair frame.

7. The adjustable reclining chair of claim 6 wherein said rear support frame is resiliently constructed so as to permit a limited rocking action of the chair and its occupant.

8. An adjustable reclining chair as in claim 7 wherein said rear support frame is of generally delta-shaped configuration, having a lowermost corner from which a single foot engages the floor surface.

9. An adjustable reclining chair as in claim 7 wherein said rear support frame is of generally rectangular configuration, having two separate feet at respective ones of its lower corners for engaging the floor surface, each of said feet being separately spring mounted upon said support frame.

* * * * *